US007613000B2

(12) United States Patent
Hung et al.

(10) Patent No.: US 7,613,000 B2
(45) Date of Patent: Nov. 3, 2009

(54) HEAT DISSIPATION DEVICE AND ELECTRONIC DEVICE WITH THE SAME

(75) Inventors: Jui-Wen Hung, Taipei Hsien (TW); Ching-Bai Hwang, Taipei Hsien (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/953,714

(22) Filed: Dec. 10, 2007

(65) Prior Publication Data

US 2009/0103264 A1 Apr. 23, 2009

(30) Foreign Application Priority Data

Oct. 19, 2007 (CN) ..... 2007 1 0123989

(51) Int. Cl.

| | |
|---|---|
| ***H05K 7/20*** | (2006.01) |
| ***F28F 7/00*** | (2006.01) |
| ***F28F 13/00*** | (2006.01) |
| ***F03D 11/04*** | (2006.01) |
| ***F04D 29/40*** | (2006.01) |

(52) U.S. Cl. ..... 361/695; 165/80.3; 165/121; 415/213.1; 415/214.3; 417/423.7; 361/694

(58) Field of Classification Search ..... 415/213.1, 415/214.1; 417/423.7

See application file for complete search history.

(56) References Cited

U.S. PATENT DOCUMENTS

| | | | | |
|---|---|---|---|---|
| 6,388,196 | B1 * | 5/2002 | Liu et al. | 174/135 |
| 7,277,281 | B1 * | 10/2007 | Lu et al. | 361/695 |
| 2005/0141193 | A1 * | 6/2005 | Otsuki et al. | 361/695 |
| 2005/0225939 | A1 * | 10/2005 | Otsuki et al. | 361/695 |
| 2005/0253467 | A1 * | 11/2005 | Watanabe et al. | 310/71 |
| 2007/0029071 | A1 * | 2/2007 | Hwang et al. | 165/104.33 |
| 2008/0023176 | A1 * | 1/2008 | Peng et al. | 165/80.3 |
| 2008/0152489 | A1 * | 6/2008 | Alex et al. | 415/213.1 |

* cited by examiner

*Primary Examiner*—Gregory D Thompson
(74) *Attorney, Agent, or Firm*—Frank R. Niranjan

(57) ABSTRACT

A heat dissipation device includes a fan (200), a first wire collection structure (280) and a second wire collection structure (290). The fan (200) includes a frame (210) and an impeller (240) disposed in the frame (210). The first wire collection structure (280) is formed on the frame (210) to collect wires (270) of the fan (200). The second wire collection structure (290) is formed on the frame (210) and configured for collecting wires (460) of another component other than the fan (200).

14 Claims, 3 Drawing Sheets

HEAT DISSIPATION DEVICE AND ELECTRONIC DEVICE WITH THE SAME

BACKGROUND OF THE INVENTION

1. Field of the Invention

The present invention relates to a heat dissipation device, and particularly to a heat dissipation device with wire collection structures to fix and protect wires of the heat dissipation device and an electronic device in which the heat dissipation device is received.

2. Description of Related Art

Computers have become a common tool used almost everyday in most homes. The computer not only makes previously complicated tasks relatively simple, but also allows people to do things previously considered impossibly complex or difficult or simply too time-consuming. In modern life, computers are playing a more and more important role. For business people required to work or speak away from their offices, notebook computers are becoming common tools because notebook computers are convenient to take out of the office and use. As notebook computers have become more powerful, they generate much more heat and have a higher internal temperature. High internal temperatures damage the electrical and electronic components of the notebook computers. Therefore, it is absolutely necessary to provide heat dissipation devices for proper cooling of the notebook computers.

As a result of the intense price competition among the computer manufacturers, the computer manufacturers are motivated to reduce the bill of materials of computers, for example reducing the price of heat dissipation devices, enabling higher profit. This puts a great pressure on heat dissipation device manufacturers. As a countermeasure, the heat dissipation device manufacturers try to increase additional functions of heat dissipation devices so as to help the computer manufacturers to enhance competitiveness.

Furthermore, each computer includes a plurality of electronic components having wires, which are needed to be fixed in orderly formation. It is desirable to provide a wire collection structure to fix these wires in low cost.

What is needed, therefore, is a heat dissipation device which has an additional function of fixing and protecting wires of an electronic device in which the heat dissipation device is received

SUMMARY OF THE INVENTION

A heat dissipation device comprises a fan, a first wire collection structure and a second wire collection structure. The fan comprises a frame and an impeller disposed in the frame. The first wire collection structure is formed on the frame to collect wires of the fan. The second wire collection structure is formed on the frame and configured for collecting wires of another component other than the fan.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
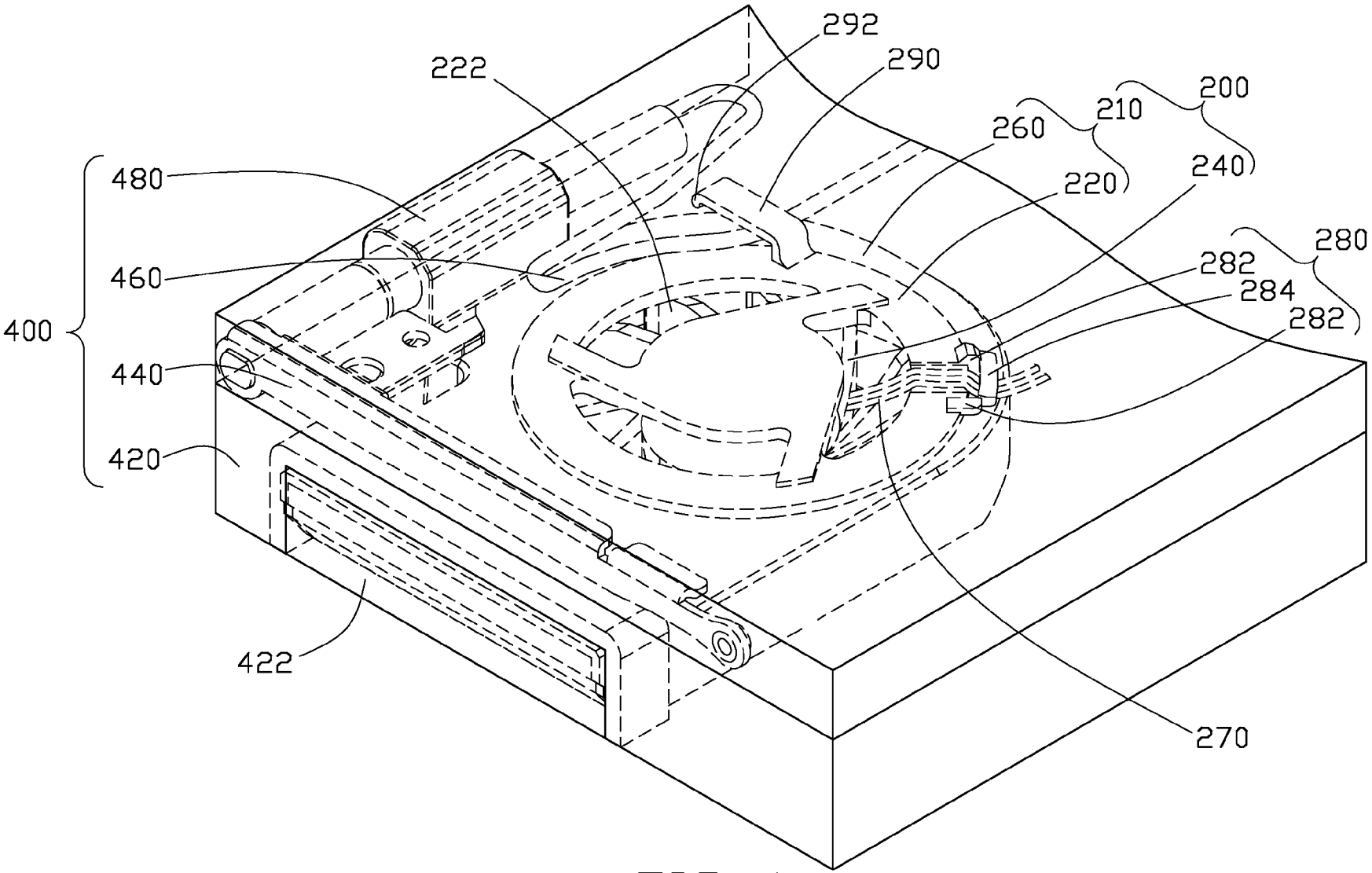
FIG. 1 is an isometric view of a heat dissipation device in accordance with a preferred embodiment of the present invention, wherein the heat dissipation device is shown in dotted line and installed in a notebook computer.
Figure 2:
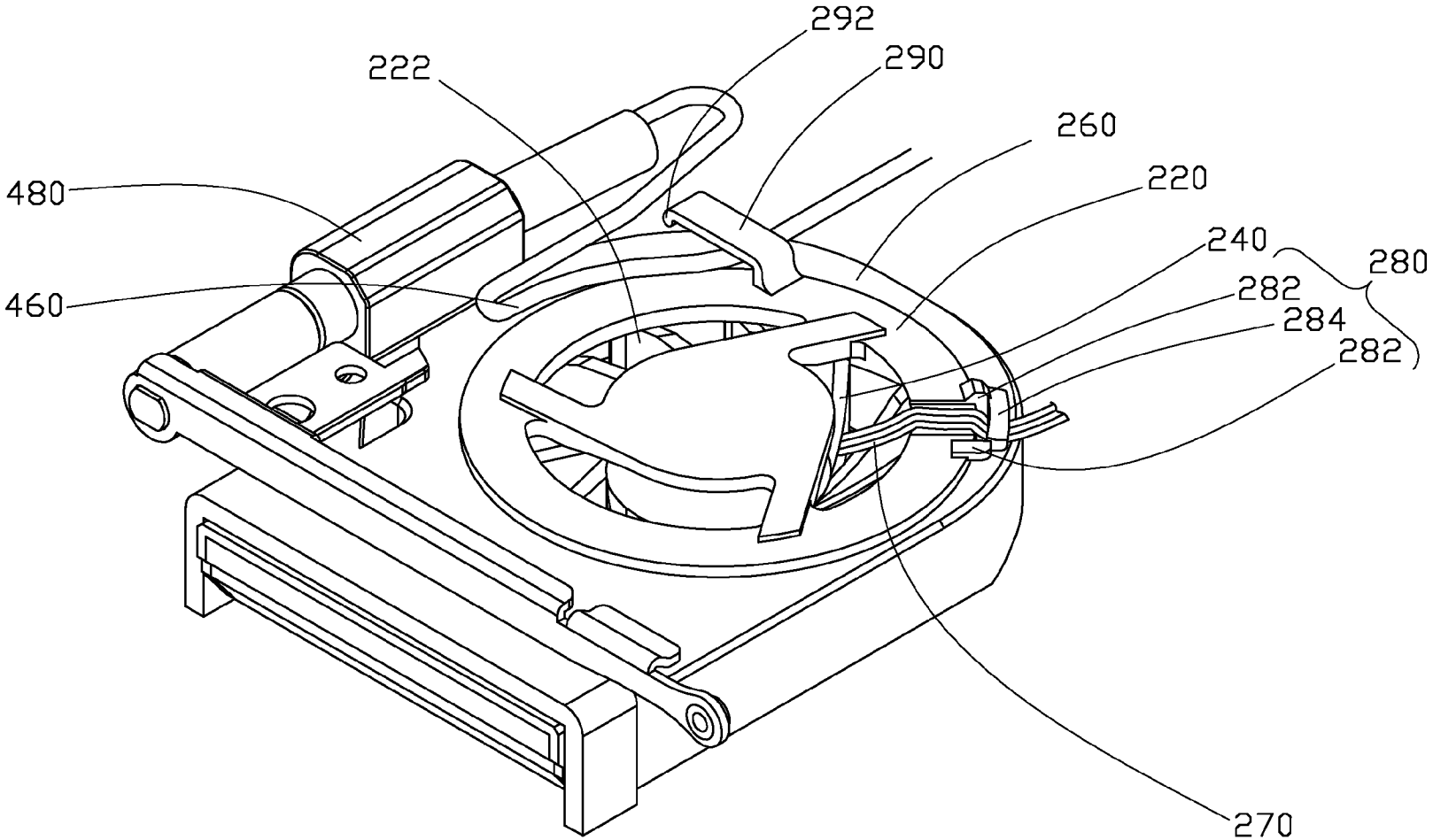
FIG. 2 is an isometric view of the heat dissipation device of FIG. 1.
Figure 3:
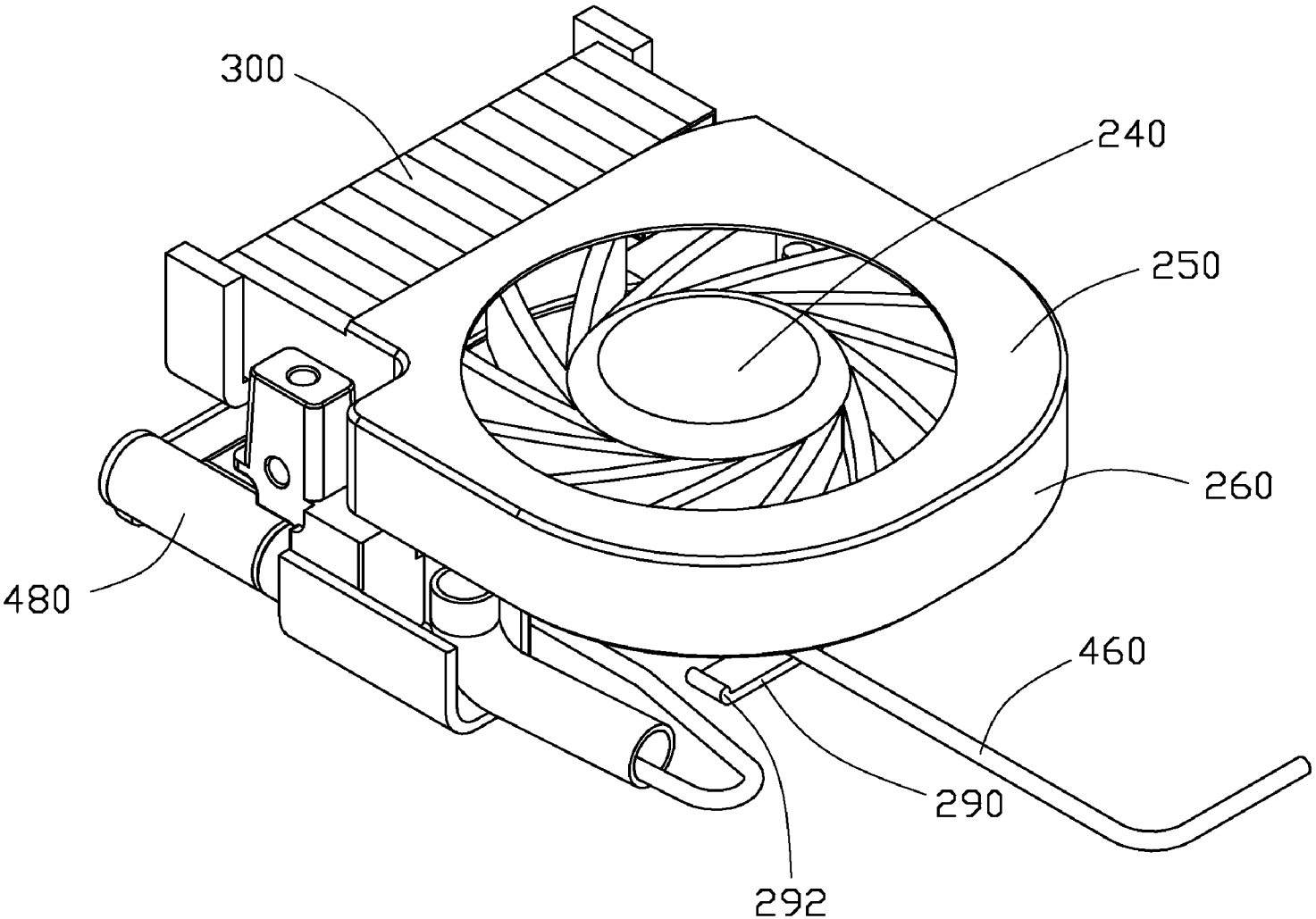
FIG. 3 is similar to FIG. 2, viewed from another aspect.

Referring to FIGS. 1-3, a heat dissipation device of a preferred embodiment of the invention is illustrated. The heat dissipation device comprises a fan 200 and a heat sink 300 positioned at an air outlet of the fan 200. The fan 200 comprises a frame 210 and an impeller 240 disposed in the frame 210. The frame 210 comprises a base 220, a cover 250 and a sidewall 260 extending between the base 220 and the cover 250. The cover 250 is detachably mounted on the sidewall 260 and the impeller 240 is retained in a chamber defined by the base 220, the cover 250 and the sidewall 260.

The base 220 has a circular plate structure, and has a plurality of openings 222 defined therein. The openings 222 serve as air inlets of the fan 200. Wires 270 of the fan 200 extend out of the chamber through one opening 222 to electrically connect with a power supply (not shown). A first wire collection structure 280 is formed on the base 220, and used for fixing and protecting the wires 270 of the fan 200 so that the wires 270 of the fan 200 will not get loose or engulfed into the fan 200 due to vibration and air flow of the fan 200.

The first wire collection structure 280 comprises two spaced parallel blocks 282 extending outwardly from the outer edge of base 220, and a beam 284. The beam 284 perpendicularly extends from one of the block 282 towards the other block 282 with an interval left between the other block 282 and free end of the beam 284. The wires 270 of the fan 200 can easily slide into the first wire collection structure 280 from the interval, and the assembly process of the heat dissipation device is simplified. Furthermore, in order to keep the wires 270 of the fan 200 tightly retained between the base 220 and the sidewall 260, a vertical distance between the beam 284 and the sidewall 260 is predetermined so that the wires 270 of the fan 200 is tightly held between the beam 284 and the sidewall 260 after the wires 270 of the fan 200 have slid into the first wire collection structure 280.

For further increasing the additional value of the heat dissipation device, a second wire collection structure 290 is formed on the base 220 away from the first wire collection structure 280. The second wire collection structure 290 extends outwardly from the outer edge of the base 220 with a space left between the sidewall 260 and the second wire collection structure 290 for fixing and protecting wires of other components other than the fan 200. A protrusion 292 is formed on a free end of the second wire collection structure 290, and extends downwardly towards the sidewall 260. The protrusion 292 serves to prevent the wires of the other components from escaping out of the second wire collection structure 290.

FIG. 1 shows the heat dissipation device being used in an electronic device, such as a notebook computer 400. The heat dissipation device serves to fix wires of the notebook computer 400 in additional to heat dissipation for the notebook computer 400. The notebook computer 400 comprises a display unit 440, a main body 420 and a hinged unit 480, by which the display unit 440 is pivotably coupled to the main body 420. The display unit 440 comprises wires 460 extending through the hinged unit 480 into the main body 420 to electrically connect with corresponding components of the main body 420.

The heat dissipation device is installed in the main body 420 in such a manner that the heat sink 300, the air outlet of the fan 200 and an air vent 422 of the main body 420 are arranged in a line to accelerate heat dissipation. Meanwhile, the second wire collection structure 290 is adjacent to the hinged unit 480. Wires 460 of the screen 440 extend through the hinged unit 480 and the second wire collection structure 290 to electrically connect with the corresponding component of the main body 420. Since the wires 460 of the screen 440 are fixed in the second wire collection structure 290 in orderly formation, the wires 460 of the screen 440 are prevented from engulfed into the fan 200.

As described above, the base 220 is detachably mounted on the sidewall 260, it is convenient for user to disassemble or reassemble the heat dissipation device to repair or replace the fan 200 when the fan 200 is worn out. Furthermore, since the first wire collection structure 280 is formed on the base 220, the base 220 and the fan 200 with the wires 270 thereof can be easily removed away from the heat dissipation device at the same time when the fan 200 is needed to be repaired or replaced.

Additionally, the second wire collection structure 290 of the base 220 can be used to collect and fix wires of another component other than the fan 200 such as the wires 460 of the screen 440. The presence of the second wire collection structure 290 can increase additional value of the heat dissipation device since there is no need to provide another special structure in the main body 420 to fix wires of the another component other than the fan 200. This helps the computer manufacturers to reduce cost and enhance competitiveness.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat dissipation device comprising:

a fan comprising a frame and an impeller disposed in the frame;

a first wire collection structure being formed on the frame to collect wires of the fan; and a second wire collection structure being formed on the frame and being configured for collecting wires of another component other than the fan;

wherein the frame comprises a base, a cover and a sidewall extending between the base and the cover, the impeller is retained in a chamber defined by the base, the cover and the sidewall, and the first wire collection structure and the second wire collection structure are formed on the base.

2. The heat dissipation device as described in claim 1, wherein the first wire collection structure is away from the second wire collection structure.

3. The heat dissipation device as described in claim 1, wherein the second wire collection structure extends outwardly from an outer edge of the base.

4. The heat dissipation device as described in claim 3, wherein a space is defined between the sidewall and the second wire collection structure and configured for fixing and protecting the wires of the another component other than the fan.

5. The heat dissipation device as described in claim 4, wherein a protrusion is formed on a free end of the second wire collection structure, and extends downwardly towards the sidewall.

6. The heat dissipation device as described in claim 1, wherein the first wire collection structure comprises two spaced blocks extending outwardly from an outer edge of the base and a beam, the beam extending from one of the blocks towards the other block with an interval left between the other block and a free end of the beam.

7. The heat dissipation device as described in claim 6, wherein a space is defined between the beam and the sidewall and configured for tightly holding the wires of the fan between the beam and the sidewall.

8. The heat dissipation device as described in claim 1, further comprising a heat sink positioned at an air outlet of the fan.

9. The heat dissipation device as described in claim 1, wherein a plurality of openings is defined in the base, the wires of the fan extend out of the chamber through one of the openings into the first wire collection structure.

10. The heat dissipation device as described in claim 1, wherein the base is detachably mounted on the sidewall.

11. An electronic device comprising:

a heat dissipation device comprising a fan with wires;

an electronic component with wires;

a first wire collection structure being formed on the fan and configured for collecting wires of the fan; and a second wire collection structure being formed on the fan and configured for collecting wires of the electronic component;

wherein the fan comprises a base, a cover, a sidewall extending between the base and the cover, and an impeller disposed in a chamber defined by the base, the cover and the sidewall, and the first wire collection structure and the second wire collection structure are formed on the base.

12. The electronic device as described in claim 11, wherein the electronic device is a notebook computer and the electronic component is a screen of the notebook computer.

13. The electronic device as described in claim 11, wherein the heat dissipation device further comprises a heat sink located at an air outlet of the fan.

14. The electronic device as described in claim 13, wherein an air vent is formed in the electronic device, and the heat sink, the air outlet of the fan and the air vent are arranged in a line.

* * * * *